US007765613B2

(12) United States Patent
Carr

(10) Patent No.: US 7,765,613 B2
(45) Date of Patent: Aug. 3, 2010

(54) METHODS AND APPARATUS TO FACILITATE NURSING AN INFANT

(75) Inventor: Natascia H. Carr, San Diego, CA (US)

(73) Assignee: Little Carr, LLC, San Diego, CA (US)

( * ) Notice: Subject to any disclaimer, the term of this patent is extended or adjusted under 35 U.S.C. 154(b) by 0 days.

(21) Appl. No.: 11/681,301

(22) Filed: Mar. 2, 2007

(65) Prior Publication Data

US 2007/0214549 A1 Sep. 20, 2007

Related U.S. Application Data

(60) Provisional application No. 60/778,162, filed on Mar. 2, 2006.

(51) Int. Cl.
*A41D 1/20* (2006.01)

(52) U.S. Cl. ..... 2/104; 2/52

(58) Field of Classification Search ..... 2/104, 2/304, 323, 335, 46, 88, 48, 207, 50–52, 2/338, 339, 340, 312, 49.1–49.3, 69.5, 309, 2/327, 311; 24/301, 302, 7–9; D2/861, 862; 224/257, 258

See application file for complete search history.

(56) References Cited

U.S. PATENT DOCUMENTS 211,479 A * 1/1879 Shelby ..... 2/335
226,681 A * 4/1880 Shelby ..... 2/335
699,513 A * 5/1902 Garms ..... 2/52
801,518 A * 10/1905 Fries ..... 24/532
849,253 A * 4/1907 Mansfield ..... 2/323
1,464,380 A * 8/1923 Agee ..... 24/471
1,549,672 A * 8/1925 Lazier ..... 2/323
1,551,829 A * 9/1925 Maxwell ..... 24/299
2,195,123 A 3/1940 Neil
2,529,774 A * 11/1950 Landau ..... 2/73
2,571,888 A * 10/1951 Jesse ..... 2/49.1
2,608,692 A * 9/1952 Berg ..... 2/304
2,655,659 A 10/1953 Swearingen
2,657,392 A * 11/1953 Jackson ..... 2/323
2,722,685 A * 11/1955 Lucas ..... 2/48
3,259,916 A * 7/1966 Stepniak ..... 2/323
3,619,816 A * 11/1971 Cowen ..... 2/48
3,711,867 A 1/1973 Mott
3,977,638 A 8/1976 Woodard
4,084,299 A * 4/1978 Noda ..... 24/504
4,106,122 A 8/1978 Dodd
4,115,906 A 9/1978 Lavine et al.
4,399,594 A 8/1983 Ostermaier
4,468,816 A 9/1984 Kaufer
4,498,613 A 2/1985 Donahue et al.

(Continued)

*Primary Examiner*—Amy B Vanatta
(74) *Attorney, Agent, or Firm*—Armstrong Teasdale LLP

(57) ABSTRACT

A nursing assembly for use in nursing an infant is provided. The nursing assembly includes a blanket and a strap. The strap includes a first end and an opposite second end, a tightening mechanism slidably coupled to the strap, the tightening mechanism configured to adjust a length of the strap, and at least two coupling mechanisms coupled to the strap. A first of the at least two coupling mechanisms is coupled between the first end and the tightening mechanism, and a second of the at least two coupling mechanisms is coupled to the strap second end. The strap is removably coupled to the blanket using the at least two coupling mechanisms.

12 Claims, 7 Drawing Sheets

U.S. PATENT DOCUMENTS

| | | | | | |
|---|---|---|---|---|---|
| 4,631,754 | A | | 12/1986 | Ryan | |
| 4,651,349 | A | | 3/1987 | Heiler | |
| 4,712,251 | A | | 12/1987 | Cobble | |
| 4,964,172 | A | | 10/1990 | Bollard | |
| 4,989,268 | A | | 2/1991 | Stolhand | |
| 5,038,411 | A | | 8/1991 | St. Armand | |
| 5,042,090 | A | | 8/1991 | Cook | |
| 5,052,055 | A | | 10/1991 | Mysliwiec | |
| D349,180 | S | * | 8/1994 | Oldham | D2/624 |
| 5,414,903 | A | * | 5/1995 | Porteous | 24/9 |
| 5,469,582 | A | | 11/1995 | Livingston | |
| 5,479,662 | A | | 1/1996 | Runco | |
| 5,560,045 | A | * | 10/1996 | Rockefeller | 2/327 |
| 5,570,474 | A | | 11/1996 | Berry et al. | |
| 5,592,692 | A | | 1/1997 | Larson | |
| 5,652,958 | A | | 8/1997 | Farrell-Mestas | |
| 5,893,171 | A | | 4/1999 | Ries | |
| 5,950,261 | A | | 9/1999 | Hay et al. | |
| 5,956,762 | A | | 9/1999 | Adams | |
| 6,163,937 | A | * | 12/2000 | McKinnis et al. | 24/302 |
| 6,216,273 | B1 | | 4/2001 | Williams | |
| 6,216,274 | B1 | | 4/2001 | Harris | |
| 6,378,135 | B1 | | 4/2002 | Hemming et al. | |
| 6,389,605 | B2 | * | 5/2002 | Srivastava | 2/312 |
| D463,325 | S | | 9/2002 | Savoia | |
| 6,681,405 | B2 | | 1/2004 | Yachimec et al. | |
| D488,288 | S | * | 4/2004 | Eggers | D2/624 |
| 6,836,899 | B1 | * | 1/2005 | Glasmire | 2/52 |
| 6,865,749 | B2 | | 3/2005 | Mohney | |
| 7,114,191 | B1 | | 10/2006 | Butler-Penenberg | |
| 2003/0037363 | A1 | | 2/2003 | Speier et al. | |
| 2003/0172434 | A1 | | 9/2003 | Dodge et al. | |
| 2005/0218168 | A1 | | 10/2005 | Chua | |
| 2007/0050885 | A1 | * | 3/2007 | Steinert | 2/104 |
| 2007/0094764 | A1 | * | 5/2007 | Wakefield et al. | 2/104 |

* cited by examiner

METHODS AND APPARATUS TO FACILITATE NURSING AN INFANT

CROSS REFERENCE TO RELATED APPLICATIONS

This application claims priority to and the benefit of the filing date of U.S. Provisional Application No. 60/778,162 filed on Mar. 2, 2006, the contents of which are hereby incorporated by reference.

BACKGROUND OF THE INVENTION

This invention relates generally to devices that facilitate nursing infants, and more particularly, to methods and apparatus that facilitate discretion while nursing an infant.

Mothers today are very busy. As a result of busy schedules, mothers often find that they need to nurse their infant in a public location. Numerous devices have been developed that when used, provide a sense of privacy to a nursing mother. For example, such devices include nursing shields, aprons, or bibs that may be used to shield a mother and her infant while nursing.

However, at least some known nursing devices may actually draw attention to a nursing mother. For example, some known nursing shields create a bulky appearance when used. Moreover, because of their physical size, some of such nursing devices may be cumbersome or awkward to transport. Additionally, because of their complexity, at least some nursing devices are costly and are difficult to set up while holding an active infant.

BRIEF DESCRIPTION OF THE INVENTION

In one aspect, a nursing assembly for use in nursing an infant is provided. The nursing assembly includes a blanket and a strap. The strap includes a first end and an opposite second end, a tightening mechanism slidably coupled to the strap first end, the tightening mechanism configured to adjust a length of the strap, and at least two coupling mechanisms coupled to the strap. A first of the at least two coupling mechanisms is coupled between the first end and the second end, and a second of the at least two coupling mechanisms is coupled to the strap second end. The strap is removably coupled to the blanket using the at least two coupling mechanisms.

In a further aspect, a strap is provided. The strap includes a first end and an opposite second end, a tightening mechanism slidably coupled to the strap first end, the tightening mechanism configured to adjust a length of the strap, and at least two coupling mechanisms coupled to the strap. A first of the at least two coupling mechanisms is coupled between the first end and the second end, and a second of the at least two coupling mechanisms is coupled to the strap second end. The strap is removably coupled to the blanket using the at least two coupling mechanisms.

In another aspect, a method of constructing a nursing assembly is provided. The method includes providing a strap having a first end and an opposite second end, coupling a tightening mechanism to the strap, coupling the first end to the tightening mechanism, inserting the second end of the strap through a first coupling mechanism, threading the second end of the strap through the tightening mechanism, and coupling a second coupling mechanism to the second end of the strap.

DETAILED DESCRIPTION OF THE INVENTION

Figure 1:
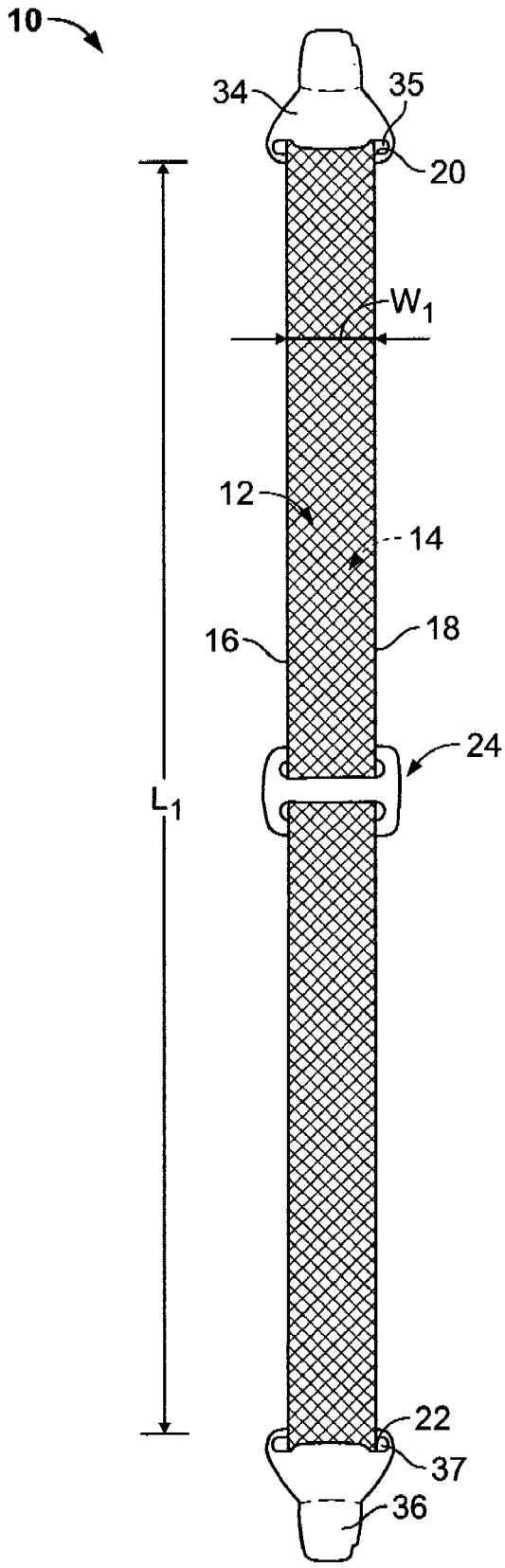
FIG. 1 is a plan view of a strap that may be used with a nursing assembly.
Figure 2:
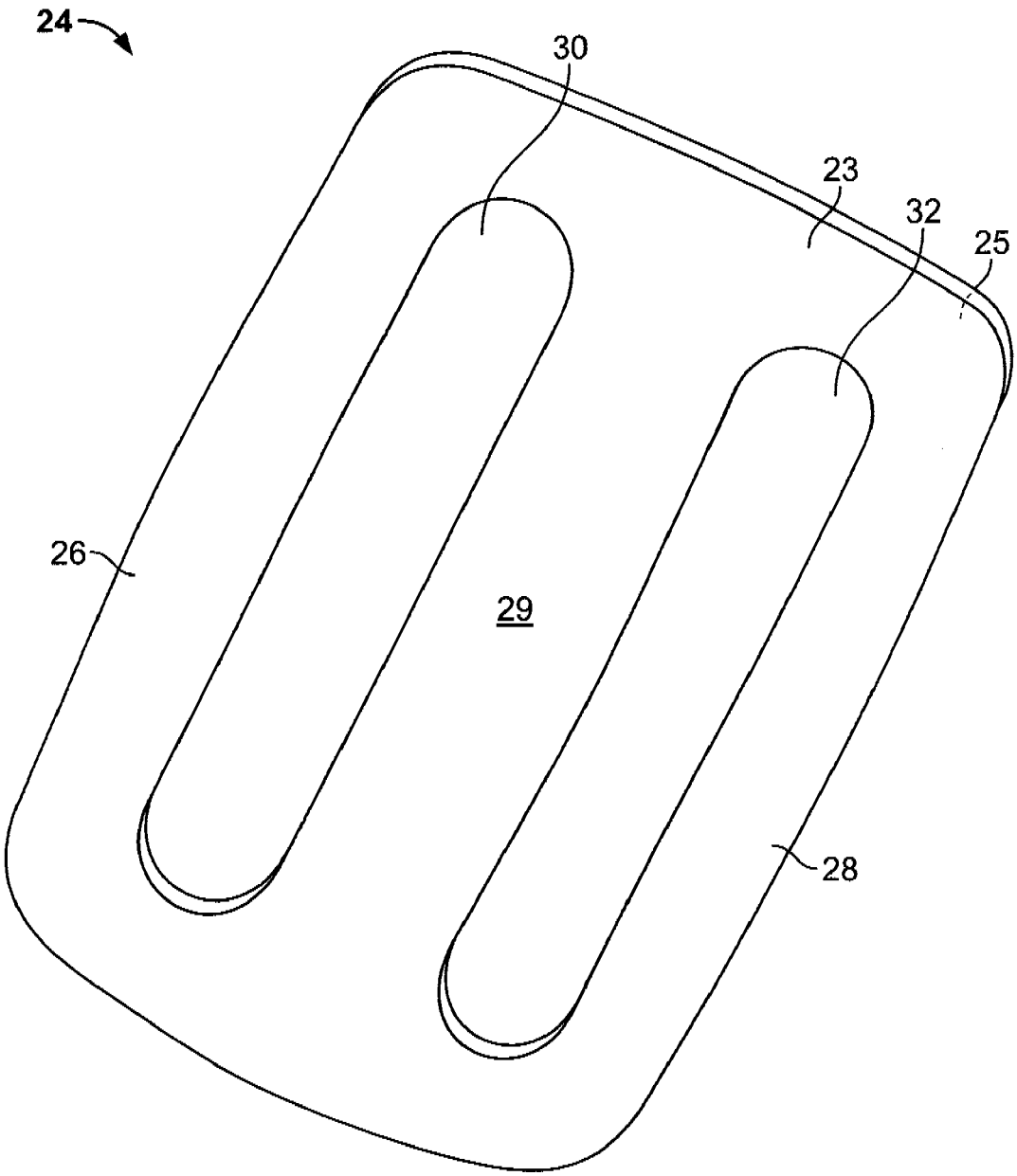
FIG. 2 is a plan view of a tightening mechanism that may be used with the strap shown in FIG. 1.
Figure 3:
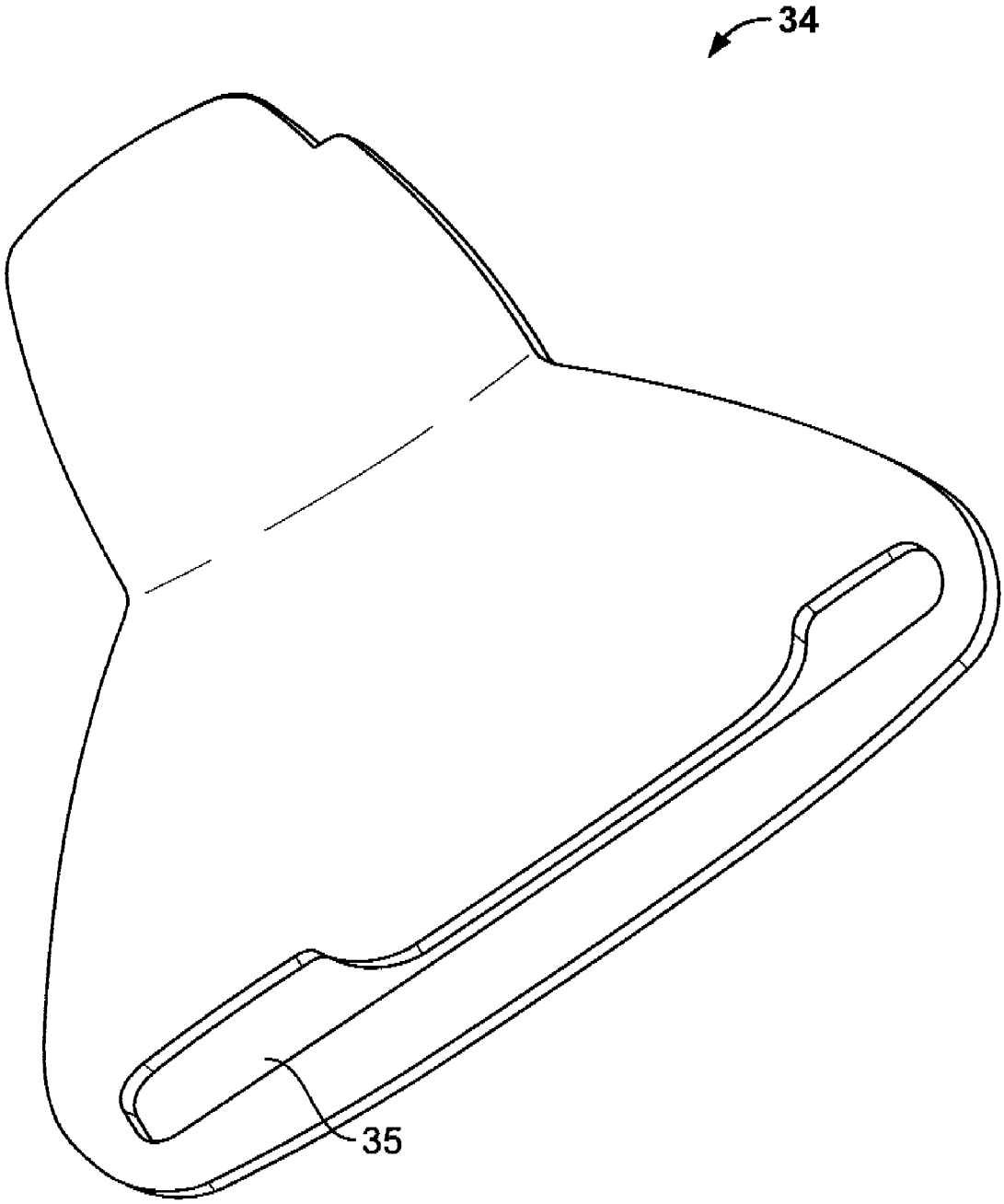
FIG. 3 is a plan view of a coupling mechanism that may be used with the strap shown in FIG. 1.
Figure 4:
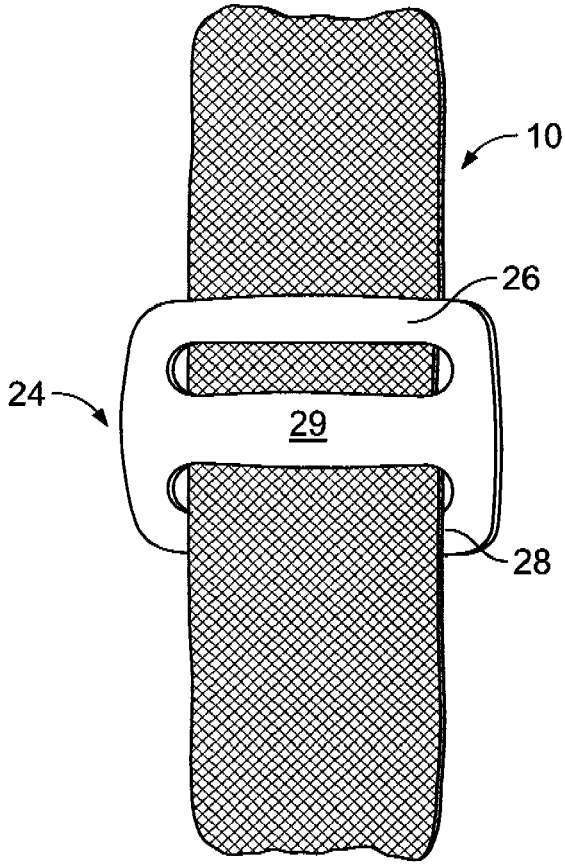
FIG. 4 is a plan view of a first portion of the strap shown in FIG. 1.
Figure 5:
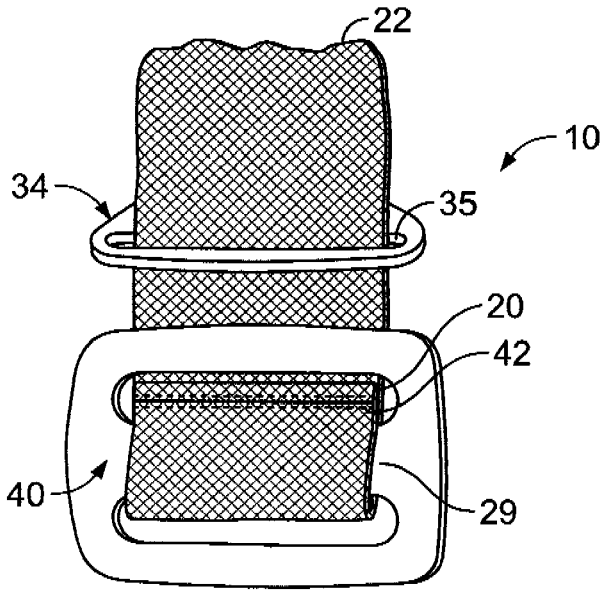
FIG. 5 is a plan view of a second portion of the strap shown in FIG. 1.

FIG. 1 is a plan view of a strap 10 that may be used with a nursing assembly (not shown in FIG. 1). FIG. 2 is a plan view of a tightening mechanism that may be used with strap 10. FIG. 3 is a plan view of a coupling mechanism that may be used with strap 10. FIG. 4 is a plan view of a first portion of strap 10. FIG. 5 is a plan view of a second portion of strap 10.

In the exemplary embodiment, strap 10 may be coupled to a blanket used by a mother to substantially cover her infant while nursing the infant. In the exemplary embodiment, strap 10 is fabricated from a flexible and durable material that is washable. For example, strap 10 may be fabricated from, but is not limited to being fabricated from, a cloth material, a plastic material, a ribbon material, a leather material, a synthetic material, a web material, and/or any combination thereof. In another embodiment, strap 10 is fabricated from a material having elastic properties. Alternatively, strap 10 may be fabricated from any material that enables strap 10 to function as described herein.

In the exemplary embodiment, strap 10 has a first surface 12 and an opposite second surface 14. Each surface 12 and 14 extends laterally between a first side edge 16 and an opposite second side edge 18. A width $W_1$ of strap 10 is measured between edges 16 and 18. Strap 10 also includes a first lateral edge 20 and a second lateral edge 22 that each extend between side edges 16 and 18. A length $L_1$ of strap 10 is measured between lateral edges 20 and 22. In the exemplary embodiment, width $W_1$ is between approximately 1.5 to approximately 3 inches, and length $L_1$ is approximately 15 to approximately 30 inches. Alternatively, strap 10 may have any length $L_1$ and/or width $W_1$ that enables strap 10 to function as described below.

In the exemplary embodiment, strap 10 includes tightening mechanism 24. Mechanism 24 is slideable and repositionable along strap 10. Specifically, in the exemplary embodiment, mechanism 24 includes a first surface 23, an opposite second surface 25, a first portion 26, and a second portion 28. In the exemplary embodiment, first and second portions 26 and 28 are formed integrally with one another and are each spaced an equidistance from a center portion 29 defined therebetween. Because first and second portions 26 and 28 are spaced from center portion 29, a pair of slots 30 and 32 are defined between center portion 29 and each portion 26 and 28. In the exemplary embodiment, slots 30 and 32 are generally parallel to one another. Alternatively, slots 30 and 32 may be at any orientation that enables mechanism 24 to function as described herein. Specifically, strap 10 is sized to be received within slots 30 and 32, as will be discussed in more detail below. In the exemplary embodiment, mechanism 24 is fabricated from a durable material. For example, mechanism 24 may be fabricated from a material, such as, but is not limited to being fabricated from a cloth material, a metal material, a ribbon material, a leather material, a plastic material, and/or any combination thereof. Alternatively, mechanism 24 may be fabricated from any material that enables mechanism 24 to function as described herein.

In the exemplary embodiment, strap 10 includes at least two coupling mechanisms 34 and 36 that are coupled to strap 10. Coupling mechanisms 34 and 36 are configured to couple strap 10 to a blanket (not shown in FIGS. 1-4). In the exemplary embodiment, coupling mechanisms 34 and 36 each include a slot 35 and 37, respectively, that is sized to receive a portion of strap 10 therein. In the exemplary embodiment, coupling mechanisms 34 and 36 are alligator clips. Specifically, in the exemplary embodiment, coupling mechanisms 34 and 36 are each a spring-loaded clip with serrated jaws. In an alternative embodiment, coupling mechanisms 34 and 36 are any suitable coupling mechanisms, coupling members, and/or clips that enable the nursing assembly 10 to function as described herein.

During assembly, mechanism 24 is slidably coupled to strap 10. Specifically, in the exemplary embodiment, either the first or second strap lateral edges 20 or 22, respectively, is inserted through slot 30 such that strap 10 extends from slot first surface 23 to second surface 25. After lateral edge 20 or 22 is inserted through slot 30, the lateral edge 20 or 22 is inserted through slot 32 such that strap 10 extends from slot second surface 25 to first surface 23. After inserting strap 10 through slots 30 and 32, as shown in FIG. 4, strap 10 is wrapped around center portion 29 and is securely coupled to itself along interior surface 12, such that a first loop 40 is defined about center portion 29. In the exemplary embodiment, the lateral edge 20 or 22 is sewn to strap interior surface 12 as illustrated with a stitch line 42. In an alternative embodiment, lateral edge 20 or 22 is coupled to strap interior surface 12 using any suitable coupling mechanism such as, but not limited to, an adhesive, a clamp, a snap, or using any other means that enables strap 10 to function as described herein. In the alternative embodiment, mechanism 24 is removably coupled to, and is detachable from strap 10.

Once loop 40 is formed around center portion 29, coupling mechanism 34 is coupled to strap 10. Specifically, in the exemplary embodiment, the lateral edge 20 or 22 of strap 10 that is not coupled to mechanism 24 is then inserted through coupling mechanism slot 35.

In the exemplary embodiment, after insertion through slot 35, the lateral edge 20 or 22 of strap 10 that is not coupled to mechanism 24 is inserted through slot 32 such that strap 10 extends from slot second surface 25 to first surface 23. After lateral edge 20 or 22 is inserted through slot 32, the same edge 20 or 22 is inserted through slot 30 such that strap 10 extends from slot first surface 23 to second surface 25. After inserting strap 10 through slots 30 and 32, strap 10 is inserted through slot 37 of coupling mechanism 36. Strap 10 is wrapped around slot 37 and is securely coupled to itself along interior surface 12, such that a second loop (not shown) is defined about slot 37. In the exemplary embodiment, the edge 20 or 22 inserted through coupling mechanism 36 is sewn to strap interior surface 12 with a stitch line similar to stitch line 42. In an alternative embodiment, lateral edge 20 or 22 is coupled to strap interior surface 12 using any other suitable coupling mechanism such as, but not limited to, an adhesive, a clamp, a snap, or using any other means that enables strap 10 to function as described herein. In an alternative embodiment, mechanism 36 is removably coupled to, and is detachable from, strap 10.

Figure 6:
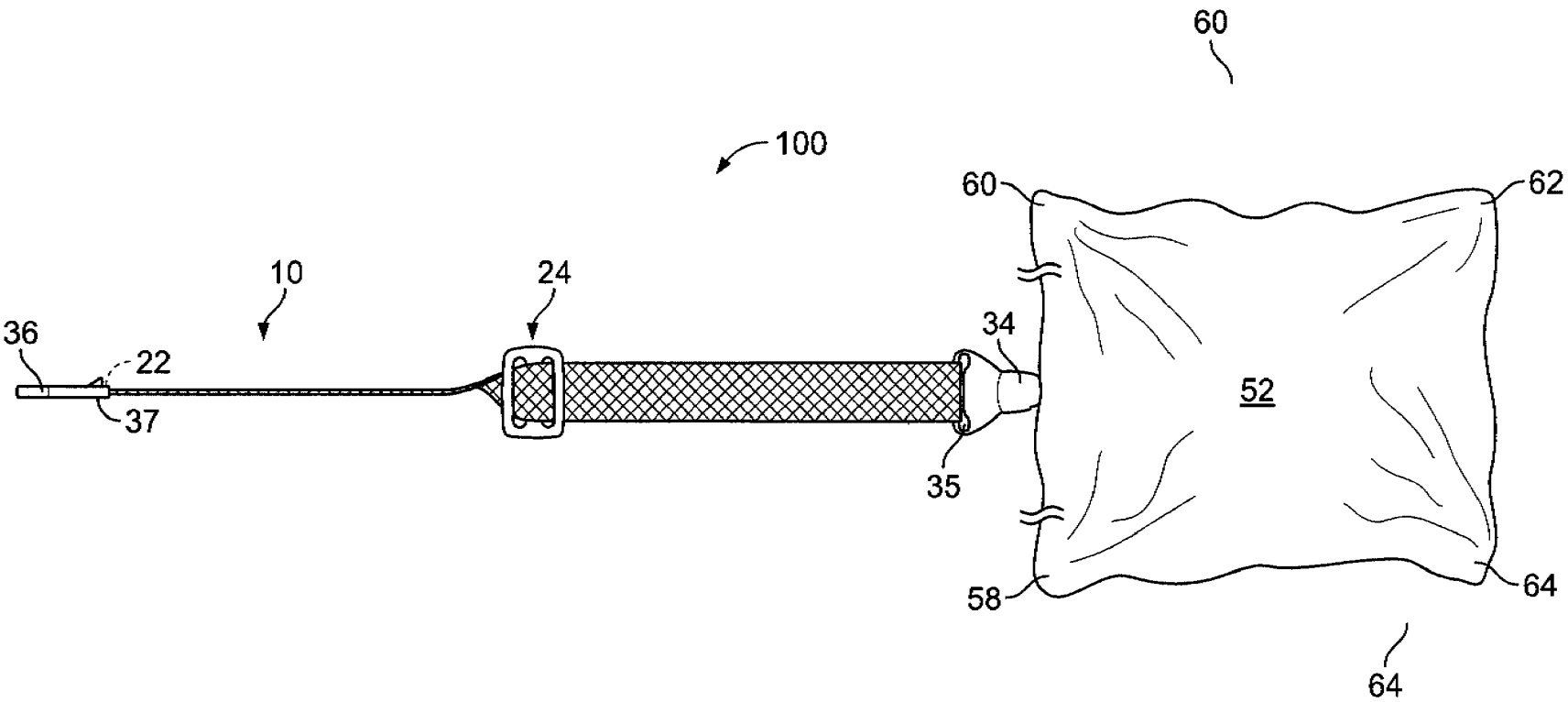
FIG. 6 is a side view of a nursing assembly including the strap shown in FIG. 1, the tightening mechanism shown in FIG. 2, and the coupling mechanism shown in FIG. 3.
Figure 7:
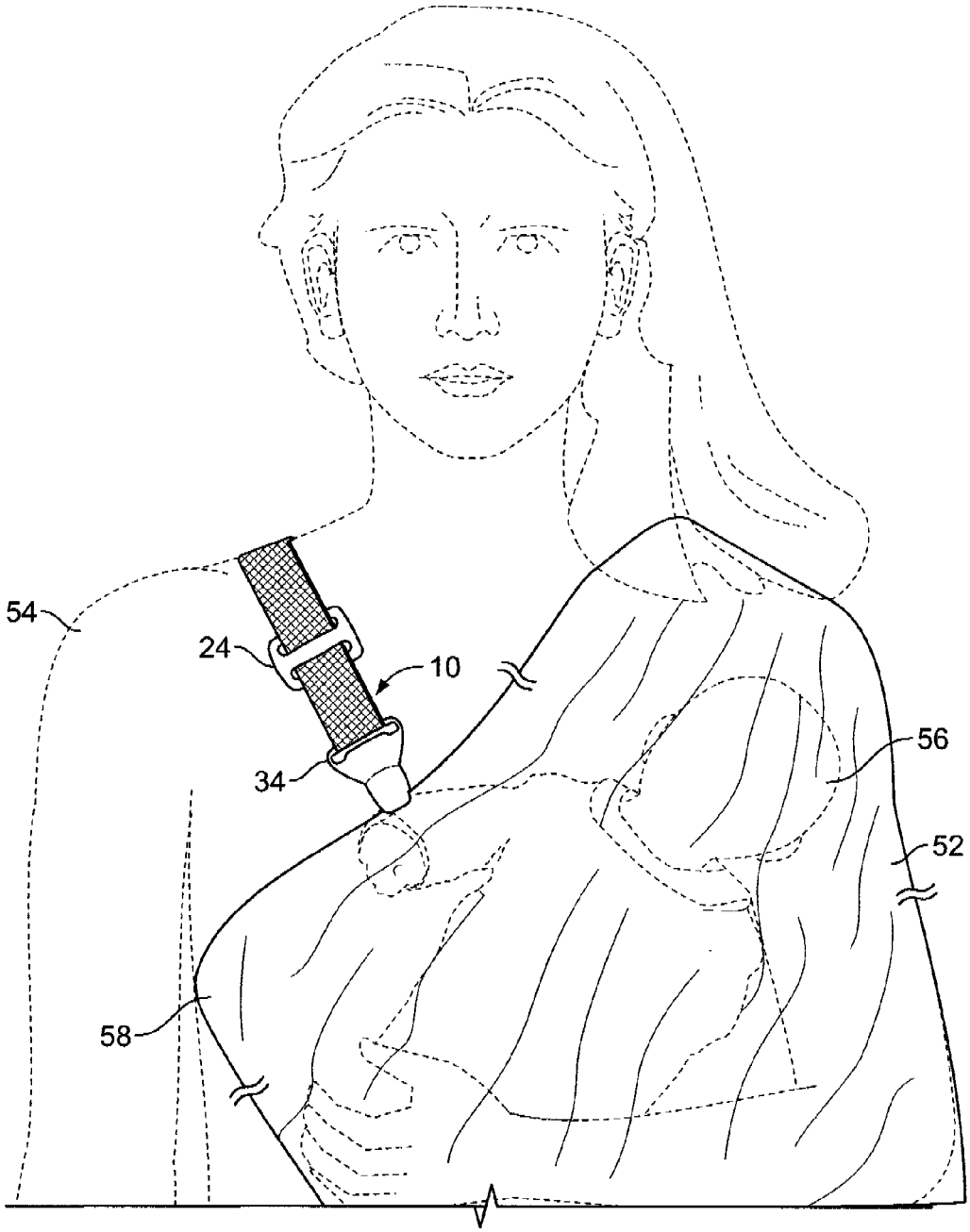
FIG. 7 is a perspective frontal view of the nursing assembly shown in FIG. 6 and in use.
Figure 8:
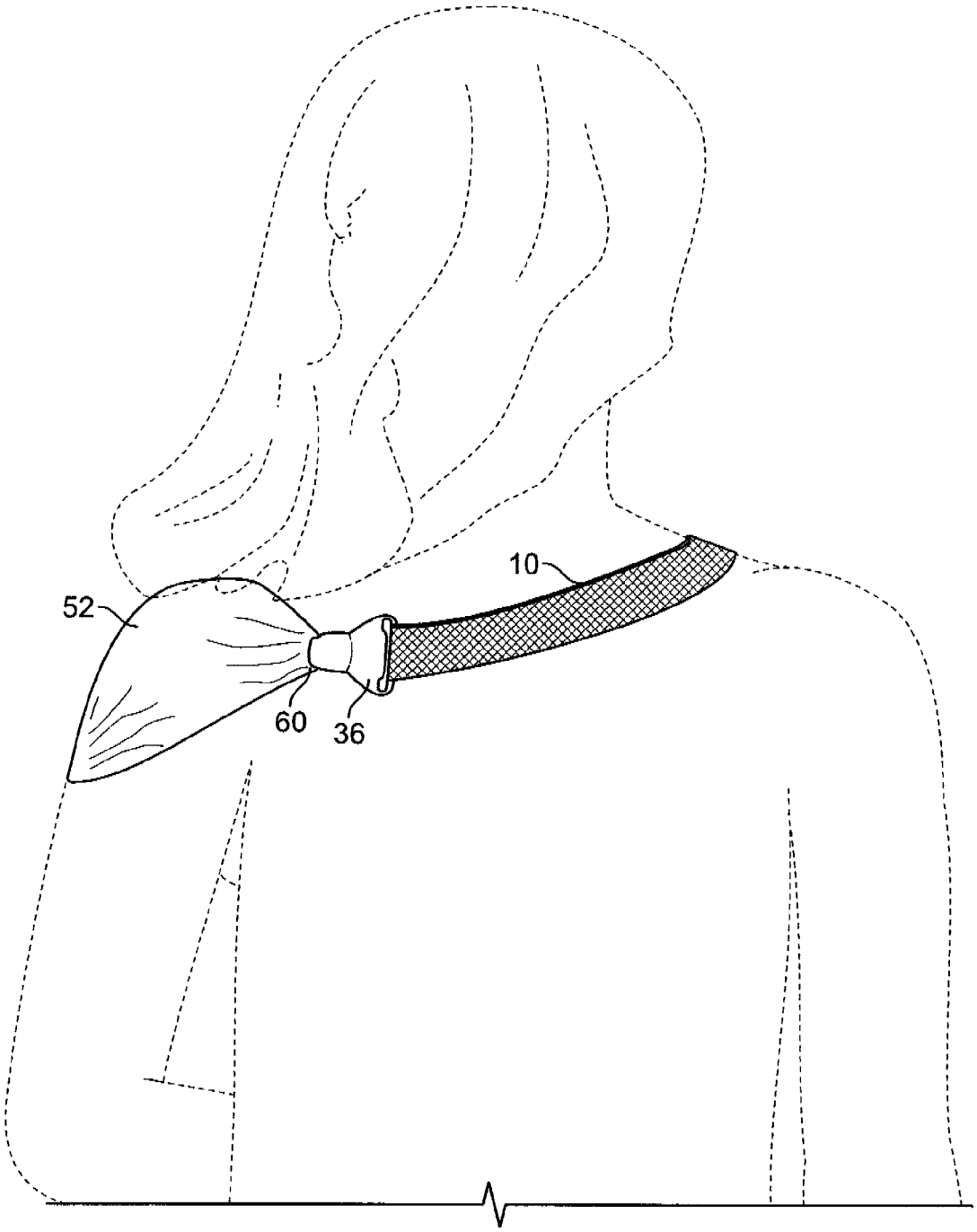
FIG. 8 is a perspective rear view of the nursing assembly shown in FIG. 7 in use.

FIG. 6 is a side view of a nursing assembly 100 including strap 10 coupled to an exemplary blanket 52. FIG. 7 is a perspective frontal view of nursing assembly 100 in use, and FIG. 8 is a perspective rear view of nursing assembly 100 in use. In the exemplary embodiment, nursing assembly 100 includes strap 10 and blanket 52, wherein strap 10 is removably coupable to blanket 52. Nursing assembly 100 provides discretion for a mother 54 while nursing her infant 56. As described in more detail below, blanket 52 is draped over the infant 56 and a portion of the mother's body to facilitate providing discretion to the mother 54 and her infant 56.

In the exemplary embodiment, blanket 52 is substantially rectangular in shape and includes four corners 58, 60, 62, and 64. Alternatively, nursing assembly 100 may use a towel or any other covering means having any shape that facilitates covering infant 56 and provides discretion to the mother 54 when nursing, as described herein.

Nursing assembly 100 is portable and as such, mother 54 may easily carry and/or pack nursing assembly 100. As shown in FIGS. 7 and 8, during use, mother 54 couples strap coupling mechanism 36 to a portion of blanket 52. For example, mother 54 couples coupling mechanism 36 to corner 60 of blanket 52. After securing coupling mechanism 36 to blanket 52, mother 54, holding infant 56 in her arms, positions a portion of blanket 52 near one of her shoulders and along her collarbone. For example, mother 54 positions blanket corner 60 over one of her shoulders and along her collarbone. Once blanket corner 60 is in position, mother 54 drapes the remaining portion of blanket 52 across a portion of her body. In the exemplary embodiment, mother 54 drapes blanket 52 across the front of her body to substantially cover infant 56. Mother 54 then drapes strap 10 over her opposite shoulder. Once infant 56 is substantially covered by blanket 52, mother 54 couples coupling mechanism 34 to the edge of blanket 60 that extends between blanket corners 58 and 60. Once nursing assembly 100 substantially covers infant 56, mother 54 is ready to nurse her infant with discretion.

Depending on the size of blanket 52, the size of mother 54, and/or the size of infant 56, the length of strap 10 is adjustable by sliding mechanism 24 along strap 10 to facilitate comfort of mother 54 and/or infant 56. Moreover, mechanism 24 is adjustable to relieve tension on strap 10 also increasing the comfort for mother 54. Furthermore, the width of strap 10 is selected to reduce and/or displace stress induced to a mother's shoulder area and back.

In an alternative embodiment, mother 54 positions nursing assembly 100 on her shoulder prior to picking up and holding her infant. In a further alternative embodiment, mother 54 couples both coupling mechanisms 34 and 36 to blanket 52 prior to positioning nursing assembly 100 across a portion of her body.

During nursing, strap 10 is substantially retained in position along the shoulder(s) and/or neck of mother 54 and does not slide off of the mother's shoulder. When nursing is complete, mother 54 may easily remove strap 10 and blanket 52 by uncoupling coupling mechanisms 34 and 36 from blanket 52.

Described herein is a nursing assembly that facilitates discretion of a mother while nursing her infant. The nursing assembly described herein is easily portable and washable.

Moreover, the nursing assembly described herein is easy to use, does not easily slide off of a mother's shoulder while she is nursing her infant, and the strap converts a blanket into a privacy shield.

An exemplary embodiment of a nursing assembly for facilitating discretion of a mother while nursing her infant is described above in detail. The nursing assembly illustrated is not limited to the specific embodiments described herein, but rather, components of the nursing assembly may be utilized independently and separately from other components described herein.

While the invention has been described in terms of various specific embodiments, those skilled in the art will recognize that the invention can be practiced with modification within the spirit and scope of the claims.

What is claimed is:

1. A nursing assembly for use in nursing an infant by a user having a first shoulder and a second shoulder, said nursing assembly comprising:

a blanket comprising a first edge and a second edge, said first edge coupled to said second edge at a corner; and a strap comprising:

a first end coupled to a tightening mechanism, an opposite second end threaded through a first coupling mechanism and said tightening mechanism, and a strap body extending between said first end and said second end, said second end coupled to a second coupling mechanism, said first coupling mechanism coupled to said corner of said blanket, said blanket extends over only the first shoulder, a length of said strap body selected to extend over only the second shoulder, said second coupling mechanism coupled to one of said first edge and said second edge of said blanket at a location spaced from said corner such that said blanket facilitates shielding the infant from external view during nursing, said tightening mechanism slidably coupled to said strap such that said tightening mechanism is configured to adjust a length of said strap.

2. A nursing assembly in accordance with claim 1 wherein said tightening mechanism comprises a first portion including a first opening defined therein, a second portion including a second opening defined therein, and a center portion extending between said first and second portions, said strap is coupled to said center portion of said tightening mechanism.

3. A nursing assembly in accordance with claim 1 wherein said first coupling mechanism and said second coupling mechanism each include an opening sized to receive said strap therethrough.

4. A nursing assembly in accordance with claim 1 wherein said strap is fabricated from at least one of a fabric material, a web material, and a plastic material.

5. A nursing assembly in accordance with claim 1 wherein said first coupling mechanism, said second coupling mechanism, and said tightening mechanism are fabricated from a plastic material.

6. A nursing assembly in accordance with claim 1 wherein at least one of said first coupling mechanism and said second coupling mechanism comprises at least one of an alligator clip, a snap-fit coupling mechanism, an adhesive, and a suspender coupling mechanism.

7. A nursing assembly in accordance with claim 1 wherein said blanket is fabricated from a fabric material.

8. A method of constructing a nursing assembly for a user having a first shoulder and a second shoulder, said method comprising:

providing a strap having a first end, a strap body, and an opposite second end;

coupling a tightening mechanism to the first end;

threading the second end of the strap through a first coupling mechanism;

threading the second end of the strap through the tightening mechanism;

coupling a second coupling mechanism to the second end of the strap;

coupling the first coupling mechanism to a blanket that extends over only the first shoulder; and extending the strap body over only the second shoulder.

9. A method in accordance with claim 8 wherein the tightening mechanism includes a first portion, a second portion, and a center portion extending between the first and second portions, said method further comprising coupling the strap to the center portion of the tightening mechanism.

10. A method in accordance with claim 8, wherein extending the strap body over only the second shoulder further comprises removably coupling the second coupling mechanism to the blanket.

11. A method in accordance with claim 8 further comprises removably coupling the tightening mechanism to the strap.

12. A method in accordance with claim 8 further comprises sliding the tightening mechanism along the strap to adjust the length of the strap.

* * * * *